US009777353B2

(12) United States Patent
Sakurada et al.

(10) Patent No.: US 9,777,353 B2
(45) Date of Patent: Oct. 3, 2017

(54) HOT-ROLLED STEEL SHEET FOR NITRIDING, COLD-ROLLED STEEL SHEET FOR NITRIDING EXCELLENT IN FATIGUE STRENGTH, MANUFACTURING METHOD THEREOF, AND AUTOMOBILE PART EXCELLENT IN FATIGUE STRENGTH USING THE SAME

(71) Applicant: Nippon Steel & Sumitomo Metal Corporation, Tokyo (JP)

(72) Inventors: Eisaku Sakurada, Tokyo (JP); Shunji Hiwatashi, Tokyo (JP); Kunio Hayashi, Tokyo (JP); Shinichi Suzuki, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 597 days.

(21) Appl. No.: 14/358,775

(22) PCT Filed: Nov. 19, 2012

(86) PCT No.: PCT/JP2012/079991

§ 371 (c)(1),
(2) Date: May 16, 2014

(87) PCT Pub. No.: WO2013/077298

PCT Pub. Date: May 30, 2013

(65) Prior Publication Data

US 2014/0334966 A1 Nov. 13, 2014

(30) Foreign Application Priority Data

Nov. 21, 2011 (JP) ..... 2011-253677

(51) Int. Cl.

| | |
|---|---|
| ***C22C 38/32*** | (2006.01) |
| ***B21B 1/22*** | (2006.01) |
| ***B21B 3/00*** | (2006.01) |
| ***C21D 9/46*** | (2006.01) |
| ***C23C 8/02*** | (2006.01) |
| ***C23C 8/26*** | (2006.01) |
| ***C23C 8/32*** | (2006.01) |
| ***C23C 8/38*** | (2006.01) |
| ***C23C 8/54*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C22C 38/26*** | (2006.01) |
| ***C22C 38/28*** | (2006.01) |
| ***C21D 1/74*** | (2006.01) |
| ***C21D 8/02*** | (2006.01) |

(Continued)

(52) U.S. Cl.

CPC ..... *C22C 38/32* (2013.01); *B21B 1/22* (2013.01); *B21B 3/00* (2013.01); *B21B 45/0269* (2013.01); *C21D 1/74* (2013.01); *C21D 8/0226* (2013.01); *C21D 8/0236* (2013.01); *C21D 9/46* (2013.01); *C22C 38/00* (2013.01); *C22C 38/004* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C23C 4/11* (2016.01); *C23C 4/134* (2016.01); *C23C 8/02* (2013.01); *C23C 8/26* (2013.01); *C23C 8/32* (2013.01); *C23C 8/38* (2013.01); *C23C 8/54* (2013.01)

(58) Field of Classification Search

CPC ..... C22C 38/22

See application file for complete search history.

(56) References Cited

U.S. PATENT DOCUMENTS

| | | | | |
|---|---|---|---|---|
| 5,810,948 A * | 9/1998 | Nishiwaki | C22C 38/28 | 148/318 |
| 2004/0035500 A1* | 2/2004 | Ikeda | C21D 1/20 | 148/320 |
| 2006/0081312 A1* | 4/2006 | Yokoi | C22C 38/001 | 148/533 |

FOREIGN PATENT DOCUMENTS

| | | |
|---|---|---|
| CN | 1166185 | 11/1997 |
| JP | 09-025544 | 1/1997 |

(Continued)

OTHER PUBLICATIONS

International Search Report dated Feb. 12, 2013 issued in corresponding PCT Application No. PCT/JP2012/079991 [with English Translation].

(Continued)

*Primary Examiner* — Jessee Roe
*Assistant Examiner* — Jophy S Koshy
(74) *Attorney, Agent, or Firm* — Birch, Stewart, Kolasch & Birch, LLP

(57) ABSTRACT

A hot-rolled steel sheet for nitriding or a cold-rolled steel sheet for nitriding, in which a dislocation density within 50 μm in the sheet thickness direction from the surface is not less than 2.0 times nor more than 10.0 times as compared to a dislocation density at the position of ¼ in the sheet thickness direction; and a method of manufacturing the same. The manufacturing method comprises, on a hot-rolled steel sheet or a cold-rolled steel sheet, performing pickling, and then performing skin pass rolling under the condition that a reduction ratio is 0.5 to 5.0% and FIT, defined as a ratio of a line load F (kg/mm) of a rolling mill load divided by a sheet width of the steel sheet and a load T (kg/mm$^2$) per unit area to be applied in the longitudinal direction of the steel sheet, is 8000 or more.

3 Claims, 6 Drawing Sheets

(51) Int. Cl.

| | |
|---|---|
| ***B21B 45/02*** | (2006.01) |
| ***C22C 38/22*** | (2006.01) |
| ***C23C 4/11*** | (2016.01) |
| ***C23C 4/134*** | (2016.01) |

(56) References Cited

FOREIGN PATENT DOCUMENTS

| | | |
|---|---|---|
| JP | 2004-292911 A | 10/2004 |
| JP | 2005-146354 | 6/2005 |
| JP | 2005-264205 | 9/2005 |
| JP | 2007-162138 | 6/2007 |

OTHER PUBLICATIONS

Korean Office Action dated May 28, 2015, issued in Korean Patent Application No. 10-2014-7013175.

* cited by examiner

HOT-ROLLED STEEL SHEET FOR NITRIDING, COLD-ROLLED STEEL SHEET FOR NITRIDING EXCELLENT IN FATIGUE STRENGTH, MANUFACTURING METHOD THEREOF, AND AUTOMOBILE PART EXCELLENT IN FATIGUE STRENGTH USING THE SAME

TECHNICAL FIELD

The present invention relates to a steel sheet for nitriding excellent in fatigue strength that secures workability and is capable of obtaining a hard nitrided layer by an nitriding treatment such as gas nitriding, gas nitrocarburizing, or salt-bath nitrocarburizing, a manufacturing method thereof, and an automobile part excellent in fatigue property having a hard nitrided layer on its surface.

This application is a national stage application of International Application No. PCT/JP012/079991, filed Nov. 19, 2012, which claims priority to Japanese Patent Application No. 2011-253677, filed on Nov. 21, 2011, the entire contents of which are incorporated herein by reference.

BACKGROUND ART

For automobiles and respective machine parts, many surface hardening treated parts are used. The surface hardening treatment is performed with the aim of improving abrasion resistance and fatigue strength, and as a representative surface hardening treatment method, carburizing, nitriding, induction heating, and the like can be cited. Nitriding treatments such as gas nitriding, gas nitrocarburizing, and salt-bath nitrocarburizing are performed at a transformation point to austenite or lower unlike other methods, to thus need a treatment time for several hours but has an advantage of capable of making heat treatment strain small.

Thus, the nitriding is a surface hardening treatment suitable for high-precision worked parts such as a crankshaft and a transmission gear in terms of automobile members or members requiring product shape accuracy after a hardening treatment of a damper disc and a damper plate formed by being pressed. Regarding the nitriding treatment, gas nitrocarburizing, salt-bath nitrocarburizing, and so on can be cited, but gas nitriding to be performed in an ammonia atmosphere makes it possible to obtain high surface hardness but generally needs a treatment time of 20 hours or longer because diffusion of nitrogen is slow. On the other hand, a nitrocarburizing treatment to be performed in a bath or an atmosphere containing carbon together with nitrogen such as gas nitrocarburizing or salt-bath nitrocarburizing makes it possible to accelerate diffusion speed of nitrogen. As a result, the nitrocarburizing treatment makes it possible to obtain a part having an increased surface hardened layer depth for several hours. By such a nitriding treatment, it is possible to form a surface hardened layer having an increased surface hardening depth, suppress fatigue crack initiation in the surface of a part, and improve fatigue endurance.

For increasing the surface hardened layer depth and surface hardness, a steel containing nitride forming alloys has been proposed to be disclosed in Patent Document 1, for example. Further, regarding a part obtained by press forming a hot-rolled steel sheet or a cold-rolled steel sheet, a gas nitrocarburizing treated steel sheet having improved workability at the time of press forming before a nitriding treatment and having an improved part surface hardness property after the nitriding treatment has been proposed to be disclosed in Patent Documents 2 and 3, for example. In each of the previously described well-known documents, for the improvement of surface hardness by the gas nitrocarburizing treatment, elements such as Al, Cr, and V being nitride forming elements are effective to be contained as alloying elements of a steel sheet for gas nitrocarburizing.

PRIOR ART DOCUMENT

Patent Document

Patent Document 1: Japanese Laid-open Patent Publication No. 2007-162138

Patent Document 2: Japanese Laid-open Patent Publication No. 2005-264205

Patent Document 3: Japanese Laid-open Patent Publication No. Hei 9-25544

DISCLOSURE OF THE INVENTION

Problems to Be Solved by the Invention

In the case of a gas nitrocarburized part formed by pressing a hot-rolled steel sheet or a cold-rolled steel sheet, for example, alloy component designing of a steel sheet achieving workability before a gas nitrocarburizing treatment and a fatigue property after the treatment is required.

For the fatigue property after the gas nitrocarburizing treatment, it is necessary to increase the surface hardness and the depth by nitrides of Al, Cr, and V. Particularly, V promotes diffusion of N to thereby increase the hardened layer depth, and Cr and Al are effective for increasing the surface hardness, but regarding Al and V, fine nitrides precipitate linearly at austenite grain boundaries to significantly deteriorate burring formability and stretch flangeability. Further, regarding V, in a cooling step after a hot finish rolling step and in a coiling step of a hot-rolled sheet, high strengthening by precipitation of V and C is promoted and workability deteriorates. In order to avoid such precipitation strengthening of V and C, it is effective to set a cooling stop temperature after hot rolling to 500° C. or lower, but lower bainite or martensite transformation is promoted and ductility decreases significantly. Thus, it is necessary to suppress a strength increase in a steel sheet for gas nitrocarburizing by decreasing the content of V as much as possible, but when V is decreased, there is caused a problem that it becomes difficult to increase the surface hardening depth after the gas nitrocarburizing treatment.

The present invention makes it possible to provide a hot-rolled steel sheet for nitriding, a cold-rolled steel sheet for nitriding excellent in fatigue strength that are capable of making a surface hardened layer deep for excellent workability before a gas nitrocarburizing treatment and fatigue strength improvement after the treatment, a manufacturing method thereof, and an automobile part excellent in fatigue strength having a nitrided layer with increased hardness in its surface layer.

Means for Solving the Problems

The present inventors examined a steel sheet alloy composition capable of obtaining a surface hardening depth without impairing formability of an automobile part by an nitriding treatment such as gas nitrocarburizing or salt-bath nitrocarburizing, a manufacturing method, and further hardness of the part.

As a result, it was found that an appropriate amount of B is contained in a steel containing appropriate amounts of Cr and V, a skin pass reduction ratio range is defined in a manufacturing step, and F/T, being a ratio of a line load F (kg/mm) of a rolling mill load of the skin pass reduction divided by a sheet width of a steel sheet and a load T ($kg/mm^2$) per unit area at the rolling outlet side being a load to be applied in the longitudinal direction of the steel sheet, is set to be in a predetermined range, and thereby a dislocation density in the sheet thickness direction of the steel sheet is defined and a hardening depth after nitriding is increased, and thereby it is possible to, while suppressing strength moderately, suppress a decrease in ductility caused by dislocation introduction, decrease roughness of a fracture surface of a sheared end surface, and secure a sufficient surface hardening depth after nitriding, and reached the present invention.

That is, the present invention is as follows.

(1) A steel sheet for nitriding excellent in fatigue strength, includes:

in mass %, C of not less than 0.0002% nor more than 0.07%; Si of not less than 0.0010% nor more than 0.50%; Mn of not less than 0.10% nor more than 1.33%; P of not less than 0.003% nor more than 0.02%; S of not less than 0.001% nor more than 0.02%; Cr of greater than 0 80% and 1.20% or less; Al of not less than 0.10% nor more than 0.50%; V of not less than 0.05% nor more than 0 10%; Ti of not less than 0 005% nor more than 0.10%; B of not less than 0.0001% nor more than 0.0015%; and a balance being composed of Fe and inevitable impurities, in which a dislocation density within 50 μm in the sheet thickness direction from the surface of the steel sheet is not less than 2.0 times nor more than 10.0 times as compared to a dislocation density at the position of ¼ in the sheet thickness direction.

(2) The steel sheet for nitriding excellent in fatigue strength according to (1), further includes:

in mass %, one or both of Mo of not less than 0 001% nor more than 0.20%; and Nb of not less than 0.001% nor more than 0.050%.

(3) A manufacturing method of a hot-rolled steel sheet for nitriding excellent in fatigue strength, includes:

on a steel billet containing, in mass %, C of not less than 0.0002% nor more than 0.07%, Si of not less than 0.0010% nor more than 0.50%, Mn of not less than 0.10% nor more than 1.33%, P of not less than 0.003% nor more than 0.02%, S of not less than 0.001% nor more than 0.02%, Cr of greater than 0.80% and 1.20% or less, Al of not less than 0.10% nor more than 0.50%, V of not less than 0.05% nor more than 0.10%, Ti of not less than 0.005% nor more than 0 10%, B of not less than 0 0001% nor more than 0.0015%, and a balance being composed of Fe and inevitable impurities, performing hot rolling; performing pickling; and then performing skin pass rolling under the condition that a reduction ratio is 0.5 to 5.0% and F/T, being a ratio of a line load F (kg/mm) of a rolling mill load divided by a sheet width of the steel sheet and a load T ($kg/mm^2$) per unit area to be applied in the longitudinal direction of the steel sheet, is 8000 or more.

(4) A manufacturing method of a cold-rolled steel sheet for nitriding excellent in fatigue strength, includes:

on a steel billet containing, in mass %, C of not less than 0.0002% nor more than 0.07%, Si of not less than 0.0010% nor more than 0.50%, Mn of not less than 0 10% nor more than 1.33%, P of not less than 0.003% nor more than 0.02%, S of not less than 0.001% nor more than 0.02%, Cr of greater than 0.80% and 1.20% or less, Al of not less than 0 10% nor more than 0.50%, V of not less than 0.05% nor more than 0.10%, Ti of not less than 0.005% nor more than 0.10%, B of not less than 0.0001% nor more than 0.0015%, and a balance being composed of Fe and inevitable impurities, performing hot rolling; performing pickling, cold rolling, and annealing; and then performing skin pass rolling under the condition that a reduction ratio is 0.5 to 5.0% and F/T (mm), being a ratio of a line load F (kg/mm) of a rolling mill load divided by a sheet width of the steel sheet and a load T ($kg/mm^2$) per unit area to be applied in the longitudinal direction of the steel sheet, is 8000 or more.

(5) An automobile part excellent in fatigue strength, in which a steel sheet that contains, in mass %, C of not less than 0.0002% nor more than 0.07%, Si of not less than 0 0010% nor more than 0.50%, Mn of not less than 0.10% nor more than 1 33%, P of not less than 0.003% nor more than 0.02%, S of not less than 0.001% nor more than 0.02%, Cr of greater than 0.80% and 1.20% or less, Al of not less than 0.10% nor more than 0.50%, V of not less than 0.05% nor more than 0.10%, Ti of not less than 0.005% nor more than 0.10%, B of not less than 0.0001% nor more than 0.0015%, and a balance being composed of Fe and inevitable impurities and in which a dislocation density within 50 μm in the sheet thickness direction from the surface of the steel sheet is not less than 2.0 times nor more than 10.0 times as compared to a dislocation density at the position of ¼ in the sheet thickness direction is formed to then be nitriding treated.

Effect of the Invention

According to the present invention, it becomes possible to provide a steel sheet having excellent press formability before a nitriding treatment and capable of obtaining a surface hardened layer with a deep depth by the nitriding treatment and further an automobile part having a surface hardened layer with a deep depth. As a result, industrial contributions such as small heat treatment strain and capability of obtaining a nitriding treated part high in fatigue strength are extremely prominent.

MODE FOR CARRYING OUT THE INVENTION

Figure 1:
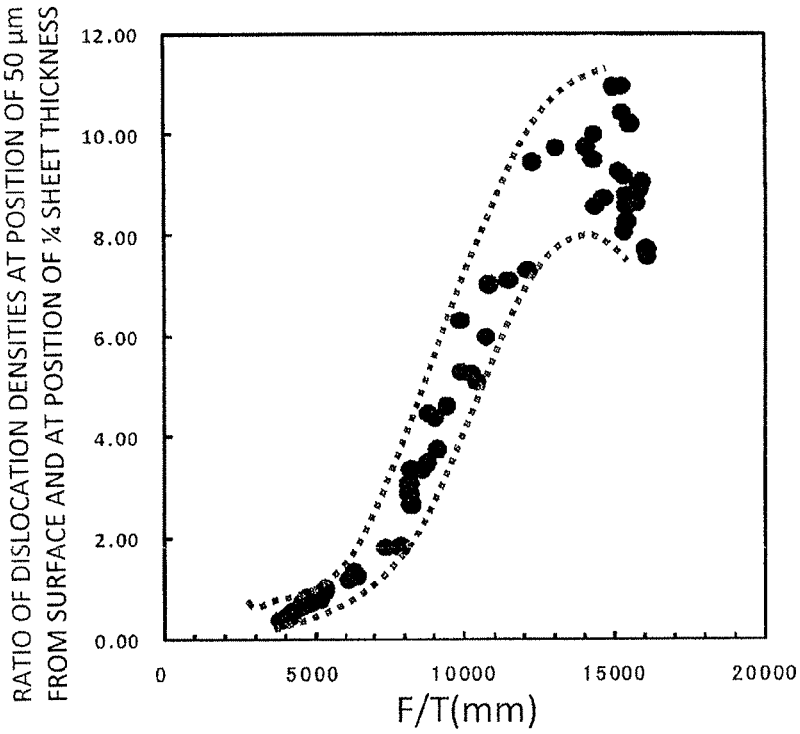
FIG. 1 is a graph showing the relationship between F/T , being a ratio of a line load F (kg/mm) of a skin pass rolling mill load divided by a sheet width of a steel sheet and a load T ($kg/mm^2$) per unit area to be applied in the longitudinal direction of the steel sheet and a ratio of dislocation densities at the position of 50 μm from the surface and at the position of ¼ sheet thickness.

In the present invention, a hot-rolled steel sheet for nitriding and a cold-rolled steel sheet for nitriding each are a steel sheet to be used as a material of a nitriding treated part. Incidentally, the steel sheet is manufactured by a later-described manufacturing method. An automobile part is an automobile part using the hot-rolled steel sheet for nitriding or the cold-rolled steel sheet for nitriding of the present invention as a material and having been subjected to a nitriding treatment after being formed. The hot-rolled steel sheet for nitriding or the cold-rolled steel sheet for nitriding of the present invention is press-formed in cold working to be subjected to cutting, sharing, punching, and the like according to need to a final product shape, and then is subjected to a nitriding treatment to thereby be an automobile part excellent in fatigue strength.

In the present invention, the "nitriding treatment" means a treatment to diffuse nitrigen into a surface layer of an iron and steel to harden the surface layer, and a treatment to diffuse nitrogen and carbon into a surface layer of an iron and steel to harden the surface layer is called a "nitrocarburizing treatment." As representative ones, gas nitriding, gas nitrocarburizing, salt-bath nitrocarburizing, and the like can be cited, and among them, the gas nitrocarburizing and the salt-bath nitrocarburizing are a nitrocarburizing treatment. Further, when a product is a nitriding treated part, it is possible to confirm that by the nitriding treatment, the surface of a steel sheet is hardened as compared to before the nitriding treatment and the concentration of nitrogen of a surface layer of the steel sheet increases.

First, in the present invention, there will be explained reasons for limiting chemical components of a steel. The limitation of chemical components is applied to each of of the present invention, the hot-rolled steel sheet for nitriding, the cold-rolled steel sheet for nitriding, and the automobile part using the same.

C is an element effective for improving strength by precipitating carbide of another carbide-forming element, and is an element that precipitates alloy carbide during a nitriding treatment and contributes also to precipitation strengthening to increase the surface hardness after the nitriding treatment. When C exceeds 0.07%, a precipitation density of cementite increases to thereby impair burring formability. Further, when C is less than 0.0002%, grain boundary strengthening decreases, and thereby secondary working brittleness deteriorates and further the cost of decarburizing in steelmaking increases too much, which is not preferable. Thus, the content of C is set to not less than 0.0002% nor more than 0.07%.

Si is a useful element as a deoxidizer, but does not contribute to improvement of the surface hardness in the nitriding treatment to make a surface hardening depth shallow. Therefore, the content of Si is preferably limited to 0.50% or less. On the other hand, when Si is decreased significantly, the cost is increased at the time of manufacture, so that the content of Si is preferably 0.001% or more. Thus, the content of Si is set to not less than 0.001 nor more than 0.50%. For obtaining a deeper surface hardening depth, the upper limit of the content of Si is more preferably 0.1% or less.

Mn is a useful element for delaying pearlite transformation in a temperature region of Ac1 or lower. When Mn is less than 0.10%, the above effect cannot be obtained. Further, when Mn exceeds 1.33%, a band structure of MnS is formed prominently, and thereby roughness of a sheared end surface increases, resulting in that an extreme deterioration of fatigue property of the sheared end surface is exhibited. Thus, the content of Mn is set to not less than 0.10% nor more than 1.33%.

P exhibits a prominent decrease in toughness caused by grain boundary segregation when exceeding 0.02%. When P is less than 0.003%, an effect that meets the cost of dephosphorization in steelmaking cannot be obtained. Thus, the content of P is set to not less than 0.003% nor more than 0.02%.

When S exceeds 0.02%, red shortness is exhibited, and further the density of MnS inclusions increases, and thereby formability is deteriorated. When S is less than 0.001%, an effect that meets the cost of desulfurization in steelmaking cannot be obtained. Thus, the content of S is set to not less than 0.001% nor more than 0 02%.

Cr is an element extremely effective for improving the surface hardness by forming carbonitride with N to enter at the time of the nitriding treatment and C in the steel. When the content of Cr is 0.8% or less, sufficient surface hardness cannot be obtained. On the other hand, when the content of Cr exceeds 1.20%, an effect is saturated. Thus, the content of Cr is set to greater than 0.8% and 1.20% or less.

Al forms nitrides with N to enter at the time of nitriding and is an element effective for increasing the surface hardness. However, when Al is contained excessively, an effective hardening depth is sometimes made shallow. When Al is less than 0.10%, sufficient surface hardness is not exhibited. When greater than 0.50% of Al is contained, diffusion of nitrogen in the depth direction is suppressed because of a high affinity for N, and thereby the surface hardening depth is decreased. Thus, the content of Al is set to not less than 0.10% nor more than 0.50%. Incidentally, when 0.30% or more of Al is contained, the surface hardness increases prominently, so that the content of Al is preferably 0.30% or more.

V is an element that contributes to strength of the steel by forming carbonitride in a hot rolling step. Further, in the present invention, similarly to Mo and Nb, V forms complex carbonitride with Cr and Al to be extremely effective for hardening of a nitrided layer. When 0.05% or more of V is contained, the surface hardness and the surface hardening depth improve prominently. On the other hand, when the content of V is greater than 0 10%, a significant increase in strength of the steel sheet caused by structure strengthening by hardenability improvement and caused by precipitation strengthening is exhibited and a deterioration of formability caused by a decrease in elongation is exhibited. Further, when V is contained excessively, a prominent decrease in toughness and a prominent deterioration of fatigue property of the sheared end surface that are caused by nitride formation in a hot rolling step are exhibited. Thus, the content of V is set to not less than 0.05% nor more than 0.10%. A more preferable range of the content is 0.07% or more.

Regarding the range of Ti, its range is determined by the balance with Al. As described previously, Al is an element extremely effective for increasing the surface hardness by forming nitrides after the nitriding treatment. On the other hand, Al is arranged in a punctate manner and precipitates at crystal grain boundaries in a γ region. Therefore, when nitrides of Al precipitate before the nitriding treatment, the end surface roughness at the time of shearing is increased to deteriorate the fatigue property of the sheared end surface. Ti has an affinity for nitrogen higher than that of Al, and nitrides of Ti are formed by priority to Al. Therefore, containing Ti makes it possible to suppress the deterioration of the fatigue property of the sheared end surface caused by the previously described nitrides of Al. However, when Ti is less than 0.005%, an Al nitride formation suppressing effect obtained by forming nitrides of Ti is not exhibited. On the other hand, when Ti exceeds 0.10%, due to a decrease in toughness of a cast slab, slab cracking during air cooling is caused. Thus, the content of Ti is set to not less than 0.005% nor more than 0.10%. The previously described sheared end surface roughness is surface roughness of an end surface at the time of shearing and indicates average roughness, and when this roughness increases, in the sheared end surface during fatigue deformation, excessive stress concentration occurs, and the fatigue property tends to deteriorate. Incidentally, for the previously described roughness, a measurement value in the sheet thickness direction of a sheared fracture surface is used.

B solid-dissolves at crystal grain boundaries, to thereby suppress grain boundary segregation of P being a grain boundary embrittling element and improve the secondary working brittleness. Further, B decreases the end surface roughness at the time of shearing to improve the fatigue property of the sheared end surface. When the content of B is less than 0.0001%, the above effect is not exhibited. Further, when greater than 0.0015% of B is contained, ferrite transformation is delayed, so that elongation of the steel sheet is decreased. Thus, the content of B is set to not less than 0.0001% nor more than 0.0015%.

Mo and Nb form complex carbonitride with Cr and Al and are extremely effective for hardening of the nitrided layer. When each content of Mo and Nb is less than 0.001%, the above effect is not exhibited. When the content of Mo exceeds 0.20%, the effect of improving the surface hardness obtained by forming carbonitride of Mo deteriorates and the ductility decreases. Therefore, the content of Mo is set to 0.01% to 0.20%.

Further, when greater than 0.050% of Nb is contained, γ recrystallization during hot rolling of the steel sheet is delayed, so that extremely high anisotropy is caused and thereby the burring formability deteriorates. Thus, the content of Nb is set to not less than 0.001% nor more than 0.05%.

Next, there will be explained a dislocation density of the steel sheet characterizing the present invention.

The dislocation promotes diffusion in the steel. During the nitriding treatment, the dislocation promotes the diffusion of nitrogen to make the surface hardening depth deep. It was newly found in the present invention that when a dislocation density within 50 μm in the sheet thickness direction from the surface of the steel sheet is 2.0 times or more as compared to a dislocation density at the position of ¼ in the sheet thickness direction, the above effect is exhibited. On the other hand, when the dislocation density within 50 μm in the sheet thickness direction from the surface exceeds 10.0 times as compared to the dislocation density at the position of ¼ in the sheet thickness direction, a prominent decrease in ductility caused by dislocation strengthening is exhibited. Incidentally, the sheet thickness of the steel sheet is 1.6 to 5.0 mm, and the present inventors found that in the case of the sheet thickness being 2.3 mm or more, in particular, a prominent effect is obtained.

A measurement value of this dislocation density is preferably obtained from a full width at half maximum by X-ray diffraction typified by the Williamson-Hall method. This is because in measurement by direct observation at a TEM, a measurement range is limited, and in fabricating an observation sample, strain is introduced and thereby a decrease in measurement accuracy is concerned. Incidentally, the obtaining method from a full width at half maximum by X-ray diffraction is described in, for example, "Evaluation method of dislocation density using X-ray diffraction" (NAKASHIMA et al. CAMP-ISIJ Vol. 17 (2004) p. 396).

The size of a measurement sample is preferably set to a size of 10 mm square or more. The surface of the measurement sample is preferably electropolished to be decreased in thickness by 50 μm or more. Thus, when a predetermined position of the sheet thickness is tried to be measured, it is necessary to consider a decreased amount of the thickness by the electropolishing and to perform mechanical polishing. Incidentally, the intact surface obtained after the mechanical polishing is not enough, and thus an accurate dislocation density cannot be obtained due to working strain. Further, for the full width at half maximum of an X ray, diffraction peaks of (110), (112), and (220) are preferably used. For example, when diffraction peaks of (200) and (311) are included, the full width at half maximum is estimated to be high extremely to make accurate measurement difficult to be performed.

Next, there will be explained a desired microstructure of the steel sheet of the present invention.

The present invention preferably has a metal structure constituted of 90% or more in total of ferrite and bainite in area ratio. When the total area ratio of the other metal structures exceeds 10%, it becomes difficult to achieve the ductility and the burring formability. Here, the other metal structures indicate austenite, martensite, and pearlite.

Identification of the metal structures of the steel can be performed by an optical microscope by nital corrosion and by a crystal structure of an X ray or a diffraction pattern. Further, discrimination using a corrosion solution other than nital may also be performed. In the case of the nital corrosion, after mirror polishing, etching is performed with a nital solution, five visual fields are observed at 500 magnifications by an optical microscope to take photographs, a portion is determined by visual observation, and the portion determined by visual observation is image-analyzed to be obtained.

Next, there will be explained a manufacturing method of the steel sheet of the present invention.

There will be explained a manufacturing method from hot rolling to pickling when the steel sheet of the present invention is a hot-rolled steel sheet. A slab being a steel billet having the previously described steel component is preferably set to a pre-rolling heating temperature of 1200° C. or higher in a heating furnace. This is to sufficiently solve contained precipitation elements, and when the heating temperature exceeds 1300° C., austenite grain boundaries become coarse, so that the heating temperature is preferably 1300° C. or lower. A hot rolling temperature is preferably 900° C. or higher. When it is lower than 900° C., deformation resistance increases, and further the formability deteriorates due to anisotropy by formation of a rolled texture. Further, for prevention of a decrease in martensite fraction, a coiling temperature is preferably 450° C. or higher after hot rolling. As long as the coiling temperature is 600° C. or higher, precipitation of carbide of Ti and V is promoted, so that the coiling temperature is between 550° C. and 600° C. A cooling rate only needs to be in a range where ferrite transformation and bainite transformation occur during cooling, and the upper limit value is preferably set to 10° C./s or less. This is because when the cooling is stopped at a cooling rate at which ferrite transformation and bainite transformation do not occur, after performing coiling into a coil shape, for example, transformations are promoted and a steel sheet coil is deformed. Incidentally, intermediate air cooling may also be performed until the temperature reaches the coiling temperature. After hot rolling is finished, pickling is performed by an ordinary method to remove scales on the surface of the steel sheet.

There will be explained a manufacturing method from hot rolling to pickling when the steel sheet of the present invention is a cold-rolled steel sheet. It is preferable that the previously described hot-rolled steel sheet should be pickled to then be subjected to cold rolling to a predetermined sheet thickness, and then should be heated in such a manner that the maximum heating temperature becomes a temperature obtained by subtracting 50° C. from an Ar3 point or higher and should be subjected to an annealing process in which cooling is performed down to a cooling stop temperature of 550° C. or lower from the previously described maximum heating temperature.

Next, there will be explained skin pass rolling. It is characterized in that the previously described pickled hot-rolled steel sheet or cold-rolled steel sheet is subjected to skin pass rolling under the condition that a reduction ratio is not less than 0.5% nor more than 5% and F/T, being a ratio of a line load F (kg/mm) of a rolling mill load divided by a sheet width of the steel sheet and a load T (kg/mm$^2$) per unit area to be applied in the longitudinal direction of the steel sheet, is 8000 or more.

The purpose of the previously described skin pass rolling is to introduce a mobile dislocation to thereby suppress yield elongation, but it was found that in addition to just setting the reduction ratio to a predetermined value, as long as the condition is set that F/T described previously is 8000 or more, it is possible to increase the dislocation density of the surface of the steel sheet and to manufacture the hot-rolled steel sheet or the cold-rolled steel sheet in which the dislocation density within 50 μm in the sheet thickness direction from the surface of the steel sheet is not less than 2.0 times nor more than 10.0 times as compared to the dislocation density at the position of ¼ in the sheet thickness direction. Hereinafter, (the dislocation density within 50 μm in the sheet thickness direction from the surface of the steel sheet)/(the dislocation density at the position of ¼ in the sheet thickness direction) is set to a "dislocation density ratio."

Figure 2:
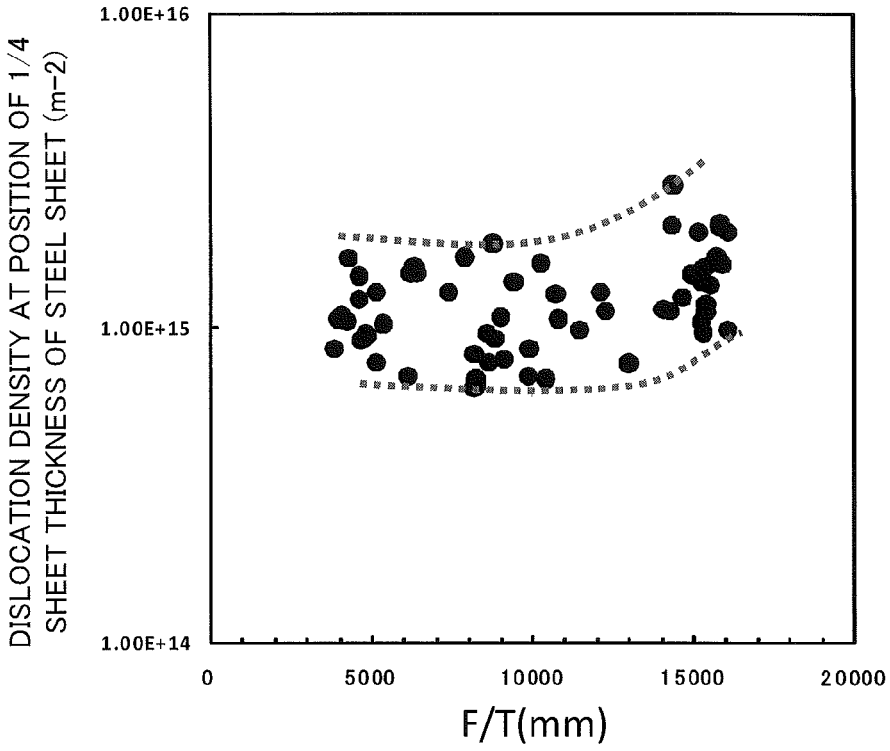
FIG. 2 is a graph showing the relationship between F/T described previously and a dislocation density at the position of ¼ sheet thickness of the steel sheet.

In FIG. 1, there are shown results obtained by examining the relationship between the skin pass condition F/T and the dislocation density ratio of hot-rolled steel sheets and cold-rolled steel sheets having components shown in Table 1. When the skin pass condition F/T was less than 8000, the dislocation density ratio was less than 2.0. Further, when F/T was not less than 8000 nor more than 14000, the dislocation density ratio was not less than 2.0 nor more than 10.0. When F/T was greater than 14000, ones each having the dislocation density ratio of greater than 10.0 appeared. In FIG. 2, there are shown effects of F/T on the dislocation density at the position of ¼ sheet thickness. When F/T exceeded 14000, the dislocation density at the position of ¼ sheet thickness increased.

When F/T is less than 8000, tension in the longitudinal direction of the steel sheet is strong, and by uniaxial tension stress, a dislocation is introduced into the whole surface of a cross section in the sheet thickness direction of the steel sheet, which is not desirable as the manufacturing method of the steel sheet of the present invention. Incidentally, as a condition of allowing a dislocation to be introduced only into the surface of the steel sheet, F/T is preferably 14000 or less. Incidentally, when the reduction ratio exceeds 5%, the dislocation is introduced down to the center in the sheet thickness direction, and thereby the ductility decreases. On the other hand, when the reduction ratio is less than 0.5%, it is found that it is not possible to suppress the yield elongation and further it becomes difficult to stably secure 8000 or more of F/T described previously. Thus, the range of the reduction ratio is set to 0.5 to 5%. Incidentally, when reduction greater than 5% is added, it is only necessary to perform an annealing step for dislocation recovery and to thereafter perform cold rolling at a reduction ratio of not less than 0.5% nor more than 5%. In this case, when an annealing temperature is 200° C. or lower, the dislocation does not recover, so that the annealing temperature is preferably 200° C. or higher.

When the steel sheet satisfying the skin pass reduction ratio, F/T, and the dislocation density ratio is nitriding treated, dislocation is introduced into the surface, and thereby diffusion of nitrogen during the nitriding treatment is promoted to make the surface hardening depth after the nitriding deep. In a nitriding treated steel sheet having this deep surface hardening depth, a crack initiation life is improved, propagation resistance of fatigue microcracking is excellent, and not only the fatigue strength but also stress at which fracture occurs at a predetermined number of cycles, namely fatigue strength at finite life is improved.

Figure 3:
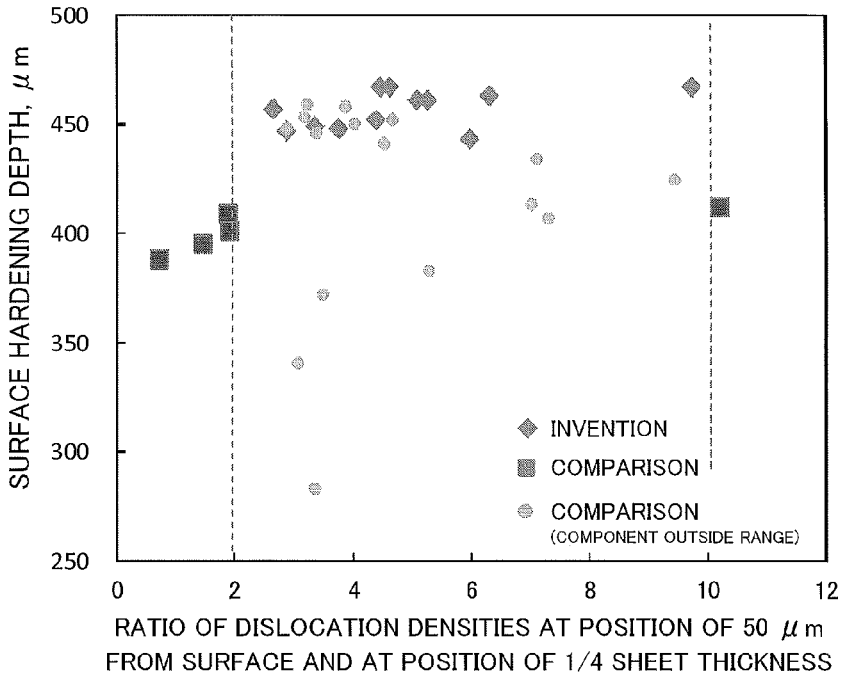
FIG. 3 is a graph showing the relationship between a ratio of dislocation densities at the position of 50 μm from the surface and at ¼ sheet thickness and a surface hardening depth.

In FIG. 3, the relationship between, of the present invention, the dislocation density ratio and the surface hardening depth is shown. When the dislocation density ratio is 2.0 or less, the surface hardening depth decreases prominently. On the other hand, in the present invention range, the deep surface hardening depth is stably exhibited, and in the implementation range, the surface hardening depth is 425 μm or more. Further, the surface hardening depth is deep by about 50 μm on average with respect to the case of the dislocation density ratio being 2.0 or less. From this result, the surface hardening depth is preferably 425 μm or more. Incidentally, the surface hardening depth is set to the distance from the surface to the position where HV starts to increase with reference to JIS-G-0557.

Figure 4:
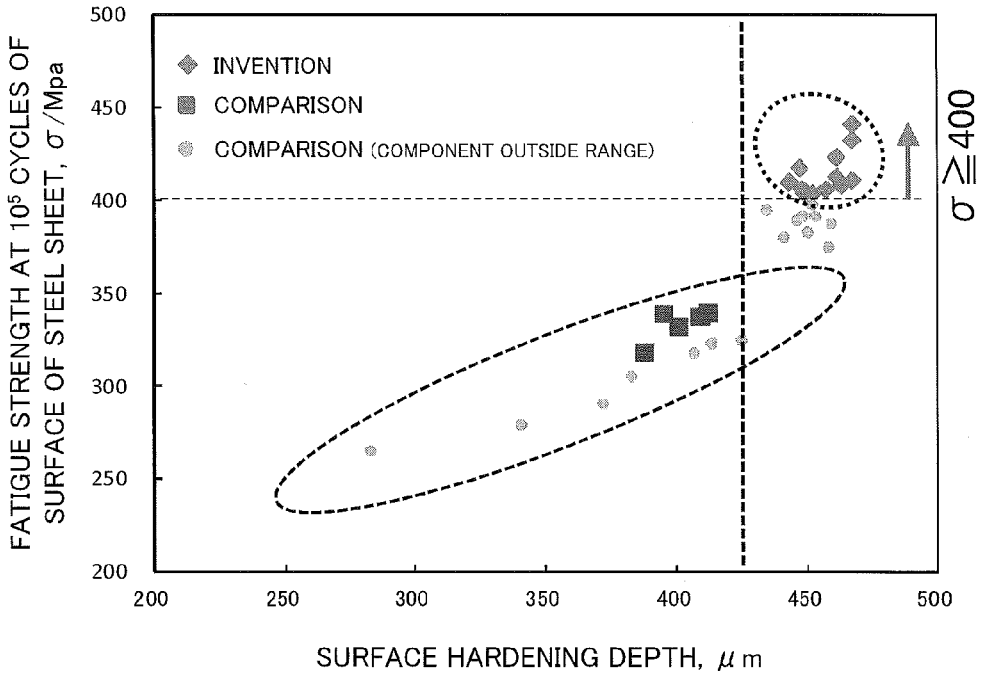
FIG. 4 is a graph showing the relationship between a surface hardening depth and a fatigue strength at $10^5$ cycles of the surface of the steel sheet.

As one evaluation of the fatigue property, the relationship between the surface hardening depth after the nitriding and a fatigue strength at $10^5$ cycles of the surface of the steel sheet is shown in FIG. 4. Incidentally, comparative steels are plotted according to the dislocation density ratio falling within the range of the present invention and the dislocation density ratio falling outside the range. The relationship between the fatigue strength at $10^5$ cycles of the surface of the steel sheet and the surface hardening depth has a positive correlation, and when the surface hardening depth is 425 μm or more in particular, the fatigue strength at $10^5$ cycles of the surface of the steel sheet increases prominently with respect to the surface hardening depth. It is found that when the surface hardening depth becomes 425 μm or more by the present invention, the fatigue strength at $10^5$ cycles of the surface of the steel sheet by the surface hardening depth improves greatly. Further, in each of the steel sheets of the present invention, appropriate components are selected and appropriate ranges are set, and thereby the fatigue strength at $10^5$ cycles of the surface of the steel sheet becomes 400 MPa or more. Incidentally, for a fatigue test, a Schenck type fatigue test was employed, and stress at which fracture occurs at $10^5$ cycles, namely the fatigue strength at $10^5$ cycles was examined. The frequency of the fatigue test was set to 25 Hz constantly and the fatigue test was performed under a test condition of displacement control. Regarding acceptance or rejection, when the surface hardening depth becomes 425 μm or more, the fatigue strength at $10^5$ cycles of the surface of the steel sheet increases prominently to be 400 σ/MPa or more, so that this is set to a threshold value.

Next, there will be explained characteristics of an automobile part obtained by nitriding treating the hot-rolled steel sheet or the cold-rolled steel sheet of the present invention. The hot-rolled steel sheet or the cold-rolled steel sheet of the present invention, as described previously, can be formed into an intended automobile part shape without impairing formability by dislocation introduction. Here, forming means press forming or bending forming after performing shearing. Further, the automobile part is a driving system part or a structural part formed from the steel sheet. The nitriding treatment is performed after forming to thereby form a nitrided layer having a deep surface hardening depth on the surface, and thereby an excellent fatigue property is exhibited. Further, the end surface roughness at the time of shearing is decreased, so that the fatigue property of the sheared end surface is also excellent. As the nitriding treatment, gas nitriding, plasma nitriding, gas nitrocarburizing, and salt-bath nitrocarburizing can be cited. When the gas nitriding is performed, for example, the automobile part is retained for 20 hours or longer in an ammonia atmosphere at 540° C. Particularly, as long as the nitriding treatment is a general gas nitrocarburizing treatment with a $N_2$+$NH_3$+$CO_2$ mixed gas at 570° C., for example, the previously described nitrided layer can be obtained for a treatment time of about five hours or longer.

EXAMPLE

Hereinafter, there will be described examples of the present invention.

TABLE 1

| STEEL SHEET No. | STEEL SHEET | C | Si | Mn | P | S | Cr | Al | V | Ti | B | Mo | Nb | |
|---|---|---|---|---|---|---|---|---|---|---|---|---|---|---|
| 1 | COLD ROLLING | 0.003 | 0.012 | 0.11 | 0.008 | 0.005 | 0.860 | 0.105 | 0.051 | 0.011 | 0.0003 | 0 | 0.010 | PRESENT INVENTION |
| 2 | COLD ROLLING | 0.003 | 0.014 | 0.13 | 0.008 | 0.005 | 0.859 | 0.107 | 0.052 | 0.012 | 0.0002 | 0 | 0 | PRESENT INVENTION |
| 3 | COLD ROLLING | 0.002 | 0.012 | 0.12 | 0.007 | 0.003 | 0.861 | 0.109 | 0.098 | 0.011 | 0.0003 | 0 | 0 | PRESENT INVENTION |
| 4 | COLD ROLLING | 0.002 | 0.012 | 0.12 | 0.007 | 0.003 | 1.150 | 0.114 | 0.052 | 0.011 | 0.0003 | 0 | 0 | PRESENT INVENTION |
| 5 | HOT ROLLING | 0.045 | 0.012 | 0.13 | 0.007 | 0.004 | 0.841 | 0.101 | 0.051 | 0.012 | 0.0002 | 0.040 | 0.002 | PRESENT INVENTION |
| 6 | COLD ROLLING | 0.003 | 0.011 | 0.12 | 0.008 | 0.005 | 0.861 | 0.252 | 0.052 | 0.013 | 0.0003 | 0 | 0.002 | PRESENT INVENTION |
| 7 | COLD ROLLING | 0.003 | 0.013 | 0.12 | 0.008 | 0.004 | 0.858 | 0.489 | 0.055 | 0.014 | 0.0003 | 0 | 0.002 | PRESENT INVENTION |
| 8 | COLD ROLLING | 0.002 | 0.45 | 0.15 | 0.008 | 0.004 | 0.847 | 0.102 | 0.051 | 0.011 | 0.0003 | 0 | 0.003 | PRESENT INVENTION |
| 9 | COLD ROLLING | 0.043 | 0.012 | 0.12 | 0.008 | 0.004 | 0.854 | 0.11 | 0.052 | 0.011 | 0.0003 | 0 | 0.002 | PRESENT INVENTION |
| 10 | HOT ROLLING | 0.059 | 0.011 | 0.13 | 0.008 | 0.004 | 0.852 | 0.108 | 0.052 | 0.012 | 0.0003 | 0 | 0.002 | PRESENT INVENTION |
| 11 | HOT ROLLING | 0.019 | 0.011 | 0.52 | 0.006 | 0.004 | 0.857 | 0.109 | 0.051 | 0.011 | 0.0003 | 0 | 0.002 | PRESENT INVENTION |
| 12 | HOT ROLLING | 0.020 | 0.011 | 1.02 | 0.007 | 0.005 | 0.856 | 0.11 | 0.051 | 0.012 | 0.0002 | 0 | 0.002 | PRESENT INVENTION |
| 13 | COLD ROLLING | 0.003 | 0.011 | 0.12 | 0.008 | 0.005 | 0863 | 0.111 | 0.154 | 0.012 | 0.0002 | 0 | 0 | COMPARISON |
| 14 | COLD ROLLING | 0.003 | 0.012 | 0.11 | 0.008 | 0.005 | 0.405 | 0.109 | 0.053 | 0.012 | 0.0003 | 0 | 0 | COMPARISON |
| 15 | COLD ROLLING | 0.003 | 0.014 | 0.13 | 0.008 | 0.005 | 2.140 | 0.112 | 0.052 | 0.013 | 0.0002 | 0 | 0.002 | COMPARISON |
| 16 | COLD ROLLING | 0.003 | 0.011 | 0.14 | 0.007 | 0.004 | 0.861 | 0.95 | 0.053 | 0.012 | 0.0002 | 0 | 0 | COMPARISON |
| 17 | COLD ROLLING | 0.003 | 0.21 | 0.85 | 0.007 | 0.005 | 0.858 | 0.11 | 0.041 | 0.011 | 0.0002 | 0 | 0 | COMPARISON |
| 18 | COLD ROLLING | 0.004 | 0.62 | 0.13 | 0.007 | 0.005 | 0.837 | 0.25 | 0.050 | 0.010 | 0.0002 | 0 | 0 | COMPARISON |
| 19 | HOT ROLLING | 0.081 | 0.012 | 0.25 | 0.007 | 0.005 | 0.853 | 0.111 | 0.053 | 0.013 | 0.0002 | 0 | 0.002 | COMPARISON |
| 20 | HOT ROLLING | 0.023 | 0.011 | 1.55 | 0.006 | 0.004 | 0.851 | 0.113 | 0.050 | 0.011 | 0.0002 | 0 | 0.002 | COMPARISON |
| 21 | HOT ROLLING | 0.060 | 0.011 | 0.25 | 0.006 | 0.002 | 0.860 | 0.11 | 0.052 | 0.109 | 0.0002 | 0 | 0.002 | COMPARISON |
| 22 | COLD ROLLING | 0.003 | 0.013 | 0.13 | 0.008 | 0.004 | 0.860 | 0.108 | 0.051 | 0.011 | 0 | 0 | 0.002 | COMPARISON |
| 23 | COLD ROLLING | 0.003 | 0.014 | 0.12 | 0.008 | 0.005 | 0.858 | 0.108 | 0.054 | 0.012 | 0.0017 | 0 | 0 | COMPARISON |
| 24 | COLD ROLLING | 0.003 | 0.0008 | 0.13 | 0.007 | 0.004 | 0.853 | 0.13 | 0.054 | 0.012 | 0.0002 | 0 | 0 | COMPARISON |
| 25 | COLD ROLLING | 0.003 | 0.012 | 0.13 | 0.008 | 0.005 | 0.852 | 0.08 | 0.053 | 0.011 | 0.0002 | 0 | 0 | COMPARISON |
| 26 | COLD ROLLING | 0.002 | 0.12 | 0.13 | 0.007 | 0.003 | 0.855 | 0.121 | 0.054 | 0.004 | 0.0011 | 0 | 0 | COMPARISON |
| 27 | HOT ROLLING | 0.041 | 0.12 | 0.25 | 0.007 | 0.003 | 0.849 | 0.122 | 0.051 | 0.011 | 0.0002 | 0.220 | 0.002 | COMPARISON |
| 28 | HOT ROLLING | 0.045 | 0.25 | 0.95 | 0.006 | 0.003 | 0.852 | 0.11 | 0.052 | 0.057 | 0.0011 | 0 | 0.070 | COMPARISON |

TABLE 2

| TEST No. | STEEL SHEET No. | SKIN PASS REDUCTION RATIO (%) | F (kg/mm) | T (kg/mm2) | F/T | DISLOCATION DENSITY AT ¼ t | DISLOCATION DENSITY WITHIN 50 μm FROM SURFACE | DISLOCATION DENSITY RATIO | NOTE |
|---|---|---|---|---|---|---|---|---|---|
| 1 | 1 | 0.8 | 1164 | 0.090 | 13000 | 7.68E+14 | 7.48E+15 | 9.7 | PRESENT INVENTION STEEL |
| 2 | 2 | 0.8 | 1012 | 0.123 | 8200 | 6.87E+14 | 1.82E+15 | 2.7 | PRESENT INVENTION STEEL |

TABLE 2-continued

| TEST No. | STEEL SHEET No. | SKIN PASS REDUCTION RATIO (%) | F (kg/mm) | T (kg/mm2) | F/T | DISLOCATION DENSITY AT ¼ t | DISLOCATION DENSITY WITHIN 50 μm FROM SURFACE | DISLOCATION DENSITY RATIO | NOTE |
|---|---|---|---|---|---|---|---|---|---|
| 3 | 3 | 0.8 | 1077 | 0.109 | 9850 | 7.01E+14 | 4.42E+15 | 6.3 | PRESENT INVENTION STEEL |
| 4 | 4 | 0.8 | 997 | 0.113 | 8800 | 9.25E+14 | 4.11E+15 | 4.5 | PRESENT INVENTION STEEL |
| 5 | 5 | 0.8 | 1074 | 0.103 | 10400 | 6.86E+14 | 3.49E+15 | 5.1 | PRESENT INVENTION STEEL |
| 6 | 6 | 0.8 | 997 | 0.122 | 8200 | 6.53E+14 | 2.19E+15 | 3.3 | PRESENT INVENTION STEEL |
| 7 | 7 | 0.8 | 1000 | 0.123 | 8150 | 6.40E+14 | 1.84E+15 | 2.9 | PRESENT INVENTION STEEL |
| 8 | 8 | 0.8 | 1041 | 0.116 | 9000 | 1.08E+15 | 4.72E+15 | 4.4 | PRESENT INVENTION STEEL |
| 9 | 9 | 0.8 | 1090 | 0.116 | 9400 | 1.39E+15 | 6.41E+15 | 4.6 | PRESENT INVENTION STEEL |
| 10 | 10 | 0.8 | 1124 | 0.110 | 10250 | 1.60E+15 | 8.39E+15 | 5.3 | PRESENT INVENTION STEEL |
| 11 | 11 | 0.8 | 1040 | 0.114 | 9100 | 7.94E+14 | 2.97E+15 | 3.7 | PRESENT INVENTION STEEL |
| 12 | 12 | 0.8 | 1093 | 0.102 | 10700 | 1.28E+15 | 7.63E+15 | 6.0 | PRESENT INVENTION STEEL |
| 13 | 13 | 0.8 | 1021 | 0.119 | 8550 | 9.57E+14 | 3.23E+15 | 3.4 | COMPARATIVE STEEL |
| 14 | 14 | 0.8 | 1098 | 0.090 | 12250 | 1.13E+15 | 1.07E+16 | 9.4 | COMPARATIVE STEEL |
| 15 | 15 | 0.8 | 1078 | 0.094 | 11450 | 9.86E+14 | 7.01E+15 | 7.1 | COMPARATIVE STEEL |
| 16 | 16 | 0.8 | 1037 | 0.121 | 8600 | 7.76E+14 | 2.60E+15 | 3.3 | COMPARATIVE STEEL |
| 17 | 17 | 0.8 | 993 | 0.122 | 8150 | 8.21E+14 | 2.51E+15 | 3.1 | COMPARATIVE STEEL |
| 18 | 18 | 0.8 | 1089 | 0.110 | 9900 | 8.58E+14 | 4.53E+15 | 5.3 | COMPARATIVE STEEL |
| 19 | 19 | 0.8 | 1103 | 0.091 | 12100 | 1.30E+15 | 9.48E+15 | 7.3 | COMPARATIVE STEEL |
| 20 | 20 | 0.8 | 1049 | 0.097 | 10800 | 1.07E+15 | 7.49E+15 | 7.0 | COMPARATIVE STEEL |
| 21 | 21 | 0.8 | 1040 | 0.119 | 8750 | 1.85E+15 | 6.44E+15 | 3.5 | COMPARATIVE STEEL |
| 22 | 22 | 0.8 | 1012 | 0.131 | 8200 | 6.21E+14 | 1.97E+15 | 3.2 | COMPARATIVE STEEL |
| 23 | 23 | 0.8 | 1108 | 0.135 | 8200 | 6.03E+14 | 2.72E+15 | 4.5 | COMPARATIVE STEEL |
| 24 | 24 | 0.8 | 985 | 0.115 | 8550 | 9.51E+14 | 3.06E+15 | 3.2 | COMPARATIVE STEEL |
| 25 | 25 | 0.8 | 996 | 0.119 | 8350 | 8.64E+14 | 3.34E+15 | 3.9 | COMPARATIVE STEEL |
| 26 | 26 | 0.8 | 1014 | 0.123 | 8250 | 1.30E+15 | 6.03E+15 | 4.7 | COMPARATIVE STEEL |
| 27 | 27 | 0.8 | 982 | 0.117 | 8400 | 1.18E+15 | 3.39E+15 | 2.9 | COMPARATIVE STEEL |
| 28 | 28 | 0.8 | 999 | 0.114 | 8750 | 1.83E+15 | 7.35E+15 | 4.0 | COMPARATIVE STEEL |
| 29 | 2 | 0.4 | 981 | 0.123 | 7950 | 6.70E+14 | 1.27E+15 | 1.9 | COMPARATIVE STEEL |
| 30 | 2 | 5.1 | 4065 | 1.845 | 7500 | 1.52E+16 | 2.22E+16 | 1.5 | COMPARATIVE STEEL |
| 31 | 2 | 5.1 | 45540 | 0.230 | 198000 | 1.36E+16 | 1.39E+17 | 10.20 | COMPARATIVE STEEL |
| 32 | 2 | 0.8 | 812 | 0.167 | 4850 | 9.42E+14 | 1.31E+15 | 0.72 | COMPARATIVE STEEL |
| 33 | 2 | 0.4 | 971 | 0.101 | 9600 | 6.43E+14 | 1.29E+15 | 2.01 | COMPARATIVE STEEL |

TABLE 3

| TEST No. | STEEL SHEET No. | STEEL SHEET | TS/MPa | El/% | λ/% | TS*El/MPa · % | TS*λ/MPa · % | SHEARED END SURFACE ROUGHNESS |
|---|---|---|---|---|---|---|---|---|
| 1 | 1 | COLD ROLLING | 413 | 36.7 | 89.9 | 0 | 31464 | 1.71 |
| 2 | 2 | COLD ROLLING | 345 | 37.9 | 88.5 | 13087 | 30545 | 1.90 |
| 3 | 3 | COLD ROLLING | 389 | 35.9 | 78.5 | 13939 | 30521 | 2.03 |
| 4 | 4 | COLD ROLLING | 388 | 37.1 | 67.0 | 14389 | 25985 | 2.02 |
| 5 | 5 | HOT ROLLING | 433 | 38.0 | 81.2 | 16475 | 28669 | 1.91 |
| 6 | 6 | COLD ROLLING | 345 | 38.0 | 120.0 | 13086 | 41356 | 1.97 |
| 7 | 7 | COLD ROLLING | 320 | 39.2 | 110.1 | 12540 | 35239 | 1.95 |
| 8 | 8 | COLD ROLLING | 369 | 36.2 | 108.0 | 13372 | 39853 | 1.99 |
| 9 | 9 | COLD ROLLING | 631 | 24.2 | 120.4 | 15296 | 76014 | 2.06 |
| 10 | 10 | HOT ROLLING | 667 | 23.2 | 98.0 | 15449 | 65340 | 2.09 |
| 11 | 11 | HOT ROLLING | 458 | 28.9 | 118.3 | 13211 | 54148 | 1.94 |
| 12 | 12 | HOT ROLLING | 531 | 23.0 | 113.2 | 12194 | 60102 | 2.03 |
| 13 | 13 | COLD ROLLING | 396 | 26.6 | 67.3 | 10542 | 26678 | 2.01 |
| 14 | 14 | COLD ROLLING | 385 | 37.8 | 97.0 | 14545 | 37326 | 1.69 |
| 15 | 15 | COLD ROLLING | 418 | 31.3 | 111.0 | 13295 | 46426 | 2.07 |
| 16 | 16 | COLD ROLLING | 336 | 40.1 | 123.8 | 13449 | 41542 | 1.70 |
| 17 | 17 | COLD ROLLING | 445 | 35.4 | 85.0 | 15727 | 37798 | 1.99 |
| 18 | 18 | COLD ROLLING | 392 | 35.6 | 72.0 | 13968 | 28252 | 1.83 |
| 19 | 19 | HOT ROLLING | 735 | 18.2 | 42.0 | 13375 | 30885 | 2.81 |
| 20 | 20 | HOT ROLLING | 572 | 20.7 | 81.5 | 11845 | 46638 | 16.50 |
| 21 | 21 | HOT ROLLING | 822 | 15.1 | 55.0 | 12449 | 45175 | 2.15 |
| 22 | 22 | COLD ROLLING | 352 | 37.2 | 92.1 | 13094 | 30545 | 21.40 |
| 23 | 23 | COLD ROLLING | 361 | 37.0 | 93.5 | 13357 | 33754 | 1.91 |
| 24 | 24 | COLD ROLLING | 337 | 37.5 | 91.2 | 12638 | 30734 | 1.76 |

TABLE 3-continued

| | | | | | | | | |
|---|---|---|---|---|---|---|---|---|
| 25 | 25 | COLD ROLLING | 351 | 36.4 | 94.0 | 12776 | 32994 | 1.86 |
| 26 | 26 | COLD ROLLING | 371 | 28.5 | 67.5 | 10574 | 25043 | 15.40 |
| 27 | 27 | HOT ROLLING | 632 | 22.1 | 65.1 | 15072 | 44398 | 1.71 |
| 28 | 28 | HOT ROLLING | 761 | 20.4 | 42.4 | 15524 | 32266 | 2.19 |
| 29 | 2 | COLD ROLLING | 337 | 38.1 | 89.1 | 12840 | 30027 | 1.89 |
| 30 | 2 | COLD ROLLING | 383 | 24.1 | 82.5 | 15230 | 31598 | 1.75 |
| 31 | 2 | COLD ROLLING | 421 | 23.5 | 58.2 | 19894 | 24502 | 1.65 |
| 32 | 2 | COLD ROLLING | 344 | 38.0 | 90.0 | 13072 | 30960 | 1.85 |
| 33 | 2 | COLD ROLLING | 345 | 38.2 | 87.8 | 13179 | 30291 | 1.84 |

| TEST No. | SURFACE HARDNESS AFTER NITRIDING/Hv | HARDENING DEPTH AFTER NITRIDING/μm | FATIGUE STRENGTH AT 10^5 CYCLES OF SHEARED END SURFACE | FATIGUE STRENGTH AT 10^5 CYCLES OF SURFACE OF STEEL SHEET | NOTE |
|---|---|---|---|---|---|
| 1 | 821 | 467 | 153 | 432 | PRESENT INVENTION STEEL |
| 2 | 811 | 457 | 132 | 406 | PRESENT INVENTION STEEL |
| 3 | 762 | 463 | 119 | 408 | PRESENT INVENTION STEEL |
| 4 | 856 | 467 | 140 | 441 | PRESENT INVENTION STEEL |
| 5 | 852 | 461 | 131 | 423 | PRESENT INVENTION STEEL |
| 6 | 833 | 449 | 128 | 404 | PRESENT INVENTION STEEL |
| 7 | 879 | 447 | 133 | 418 | PRESENT INVENTION STEEL |
| 8 | 787 | 452 | 120 | 404 | PRESENT INVENTION STEEL |
| 9 | 799 | 467 | 122 | 411 | PRESENT INVENTION STEEL |
| 10 | 785 | 461 | 123 | 413 | PRESENT INVENTION STEEL |
| 11 | 773 | 448 | 132 | 406 | PRESENT INVENTION STEEL |
| 12 | 795 | 443 | 121 | 410 | PRESENT INVENTION STEEL |
| 13 | 814 | 446 | 119 | 389 | COMPARATIVE STEEL |
| 14 | 638 | 424 | 108 | 324 | COMPARATIVE STEEL |
| 15 | 851 | 434 | 124 | 394 | COMPARATIVE STEEL |
| 16 | 962 | 283 | 91 | 265 | COMPARATIVE STEEL |
| 17 | 767 | 341 | 90 | 279 | COMPARATIVE STEEL |
| 18 | 822 | 383 | 100 | 305 | COMPARATIVE STEEL |
| 19 | 710 | 407 | 71 | 317 | COMPARATIVE STEEL |
| 20 | 700 | 413 | 51 | 323 | COMPARATIVE STEEL |
| 21 | 682 | 372 | 86 | 290 | COMPARATIVE STEEL |
| 22 | 785 | 453 | 51 | 391 | COMPARATIVE STEEL |
| 23 | 810 | 441 | 120 | 380 | COMPARATIVE STEEL |
| 24 | 791 | 459 | 135 | 387 | COMPARATIVE STEEL |
| 25 | 722 | 458 | 120 | 375 | COMPARATIVE STEEL |
| 26 | 802 | 452 | 59 | 398 | COMPARATIVE STEEL |
| 27 | 841 | 448 | 230 | 391 | COMPARATIVE STEEL |
| 28 | 809 | 450 | 117 | 383 | COMPARATIVE STEEL |
| 29 | 781 | 409 | 112 | 337 | COMPARATIVE STEEL |
| 30 | 892 | 395 | 119 | 339 | COMPARATIVE STEEL |
| 31 | 921 | 412 | 127 | 339 | COMPARATIVE STEEL |
| 32 | 803 | 388 | 99 | 318 | COMPARATIVE STEEL |
| 33 | 822 | 401 | 109 | 332 | COMPARATIVE STEEL |

Steels of 28 kinds having chemical components shown in Table 1 were melted. Incidentally, Steel types 1 to 12 are in the component range of the present invention and Steel types 13 to 28 are comparative components each deviating from the component of the present invention. Further, C was excluded from the implementation because the component of less than 0.0002% was melted and an extremely high cost was required. Some of these steels were each hot rolled to be fabricated into a rough-rolled material having a sheet thickness of 25 mm by way of trial. The rough-rolled materials were heated to 1200 to 1250° C. to be subjected to finish rolling at a finish rolling temperature of 950° C. to then be cooled at an average cooling rate of 5° C./s in a cooling zone, and steel sheets were each coiled into a coil shape at a coiling temperature of 550° C. to thereby manufacture steel sheets each having a sheet thickness of 2.3 mm, and in a 7% hydrochloric acid aqueous solution, scales on each surface were removed, and under skin pass conditions in Table 2, rolling was performed and hot-rolled steel sheets for nitriding were obtained.

Further, hot-rolled steel sheets before skin pass rolling were each subjected to cold rolling at a cold-rolling ratio of 60%, retained for a maximum heating temperature retention time of 30 (sec) at a heating rate of 10(° C./sec), subjected to an annealing process in which cooling is performed down to 550° C. to be stopped, and rolled under the skin pass conditions in Table 2 to manufacture cold-rolled steel sheets for nitriding. In Table 2, Test numbers 1 to 12 each have the steel sheet component and the manufacturing condition falling within the ranges, Test numbers 13 to 28 each have either the steel sheet component or the manufacturing condition falling outside the range, and Test numbers 29 to 33 each have the skin pass rolling condition falling outside the range.

Of the steel sheets of all Test numbers, a full width at half maximum of X-ray diffraction was measured and a dislocation density was measured by a Williamson-Hall method. Incidentally, for the full width at half maximum of an X ray, diffraction peaks of (110), (112), and (220) were used. Incidentally, in order to measure the dislocation density at the position of 50 μm from the surface and the dislocation density at the position of 1/4 sheet thickness, a sample having a size of 25 mm length×15 mm width was cut out from each Steel type to be decreased in thickness to a predetermined measurement position by electropolishing Measurement results are as shown in Table 2, and in Test numbers 1 to 28 falling within the manufacture range of the present invention, the ratio of the dislocation densities at the position of 50 μm from the surface and at the position of ¼ sheet thickness was not less than 2.0 nor more than 10.0. In Test number 29 with the skin pass reduction ratio falling below 0.5%, F/T was 8000 or less, so that the dislocation density ratio fell below 2.0. Further, in Test number 30, the skin pass reduction ratio was 5% or more and tension was increased significantly, resulting in that in addition to the dislocation density at the position of 50 μm from the surface, the dislocation density at the position of ¼ sheet thickness increased significantly and the dislocation density ratio fell below 2.0. Further, in Test number 31, a line load at the time of skin pass rolling was increased, resulting in that the dislocation density ratio exceeded 10.0. Incidentally, as compared to Test number 2, the dislocation density at the position of ¼ sheet thickness also increased prominently.

Figure 5:
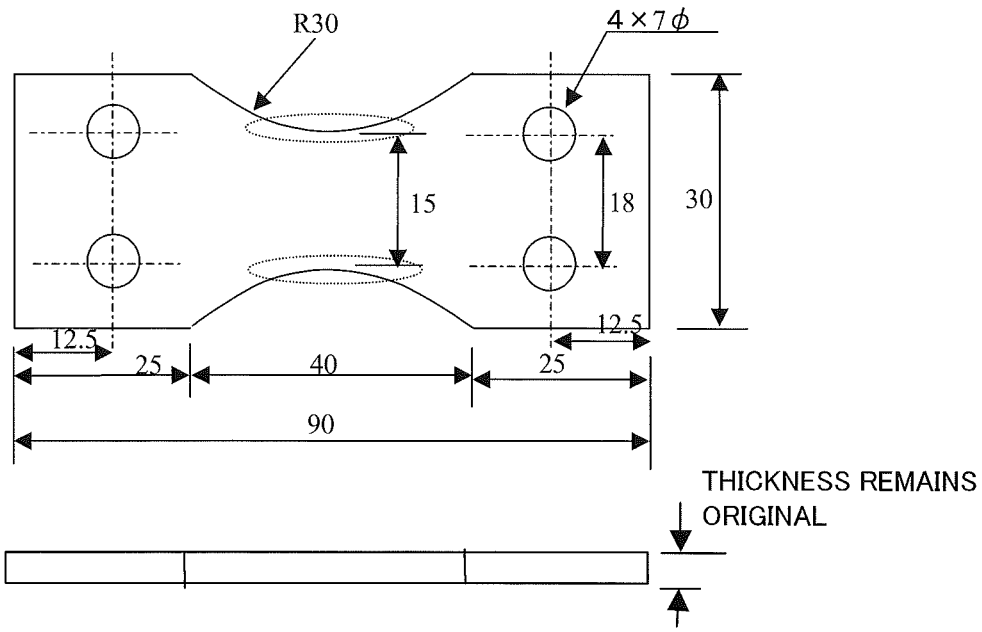
FIG. 5 is a plane bending fatigue test piece shape for evaluating a fatigue strength at $10^5$ cycles of the surface of the steel sheet after nitriding.
Figure 6:
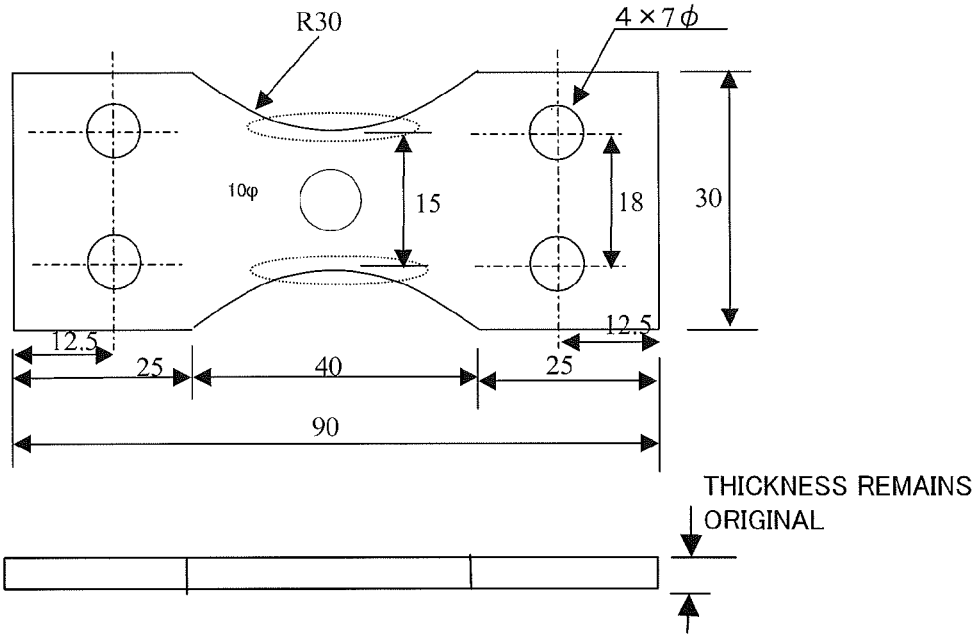
FIG. 6 is a plane bending fatigue test piece shape for evaluating a fatigue strength at $10^5$ cycles of a sheared end surface after nitriding.

Next, on all Steel types, a gas nitriding treatment was performed under the following condition. The condition of the gas nitriding treatment was set that an atmosphere is a mixed gas of $NH_3$:$N_2$:$CO_2$=50:45:5 in volume fraction, a temperature is 570° C., and a retention time is five hours. Tensile strength TS and ductility El before the nitriding treatment were evaluated in accordance with a test method described in JIS-Z2241 by fabricating a No. 5 test piece described in JIS-Z2201. Further, burring formability λ before the nitriding was evaluated in accordance with a test method described in JIS-Z2256. Roughness of a sheared end surface before the nitriding was measured by using a contact type surface roughness tester after punching and shearing were performed by using a die having a cylindrical punch with 10 mmϕ and 15% of a clearance. Incidentally, regarding the sheared end surface roughness, a fracture surface was measured in the sheet thickness direction and average roughness was employed. The steel sheets of all Test numbers were each worked into a plane test piece shown in FIG. 5 in order to examine a fatigue property of the surface of the steel sheet after the nitriding, and were each worked into a test piece shown in FIG. 6 under the previously described punching condition in order to examine a fatigue property of the sheared end surface, and nitrided fatigue test pieces that underwent the nitriding treatment under the previously described nitriding treatment condition were each fabricated and had the previously described fatigue test performed thereon. The hardness after the nitriding treatment was measured in accordance with JIS-Z-2244. Regarding a measurement place, each test piece was cut so that its L cross section could appear and was polished and HV0.3(2.9N) was measured at intervals of 10μm from ¼ of the diameter to the surface.

There are shown material properties before the nitriding treatment in Table 3.

In terms of comparison of Test numbers 2, 18, and 24 different in the content of Si, in Test number 18 having the content of Si being greater than 0.5%, the surface hardening depth decreased prominently. Further, in Test number 24 having the content of Si being less than 0.001%, the surface hardening depth slightly increased with respect to Test number 2, which was not a prominent effect. In terms of comparison of Test numbers 2, 20, and 21 different in the content of Mn, in Test number 20 having the content of Mn being greater than 1.33%, a prominent increase in the sheared end surface roughness was confirmed. In terms of comparison of the surface hardness of Test numbers 2, 4, 14, and 15 different in the content of Cr, the hardness after the nitriding was secured stably in the component range of the present invention and the hardness hardly changed even though the content of Cr exceeded 2.0%.

In terms of comparison of Test numbers 2, 6, 7, 16, and 25 different in the content of Al, in the case of the content of Al being 0.10% or more, prominent surface hardening was able to be confirmed. Further, when greater than 0.5% of Al was contained, an increase in the surface hardness was confirmed, but a prominent decrease in the surface hardening depth was confirmed. In terms of comparison of Test numbers 2, 3, 13, and 17 different in the content of V, when V exceeded 0.1%, El (%) being an index of the ductility decreased prominently. Regarding the surface hardening depth after the nitriding, when the content of V was 0.05% or more, the surface hardening depth increased prominently, but when the content of V exceeded 0.10%, the surface hardening depth tended to be saturated, and in Test number 13, the surface hardening depth rather decreased. Further, it was found that the present invention steels each contain B to thereby suppress a prominent increase in the sheared end surface roughness and are each in an appropriate range where B is not contained excessively. In terms of comparison of Test numbers 2, 22, and 26 different in the content of Ti, in Test number 22 having the content of Ti greater than 0 1%, a prominent increase in the sheared end surface roughness was confirmed. Further, also in Test number 26 having the content of Ti being less than 0.005%, a prominent increase in the sheared end surface roughness was confirmed. In terms of comparison of Test numbers 2, 23, and 24 different in the content of B, in Test number 23 not containing B, a prominent increase in the sheared end surface roughness was confirmed. Further, in Test number 24 containing greater than 0.0015% of B, an effect of decreasing the sheared end surface roughness equal to or more than the result of Test number 2 was not confirmed. In Test numbers 1 and 5 each containing Mo and Nb, an improvement of the surface hardness was confirmed. However, in Test number 27 having the content of Mo being greater than 0.20%, an improvement of the surface hardness was not confirmed, and in Test number 28 having the content of Nb being greater than 0.05%, a prominent deterioration of the burring formability λ was confirmed.

In Test number 29 having the skin pass reduction ratio of 0.4%, the dislocation density ratio fell below 2.0, and as compared to the result of Test number 2 with the same steel sheet number, an effect of improving the surface hardening depth was not confirmed. Further, in Test number 30, the reduction ratio was 5.1% and the dislocation density ratio fell below 2.0, and as compared to the result of Test number 2 with the same steel sheet number, a prominent decrease in the ductility was confirmed. Further, in Test number 31 having the dislocation density ratio being greater than 10.0, a more prominent decrease in the ductility was confirmed. Further, in Test numbers 29 to 31, a decrease in the surface hardening depth was also confirmed. In Test number 32, the skin pass reduction ratio was in the appropriate range, but F/T described previously was less than 8000, so that the dislocation density ratio was less than 2.0. Therefore, the surface hardening depth after the nitriding in Test number 32 was extremely low as compared to Test number 2. Further, in Test number 33, F/T described previously and the dislocation density ratio were satisfied, but the skin pass reduction ratio was 0.4%, so that it was confirmed that an upper yield poin a lower yield point occurred and yield elongation was not able to be suppressed.

Finally, fatigue property results of the steel sheets of the present invention are shown in Table 3. In each of the steel sheets of the present invention, the fatigue strength at $10^5$ cycles of the surface of the steel sheet was 400 MPa or more. Incidentally, in Test number 15, greater than 2.0% of Cr was contained, and as compared to Test number 4 having the content in the appropriate range, the previously described fatigue strength rather decreased, the surface hardness improved but the surface hardening depth decreased, and the fatigue strength at $10^5$ cycles of the surface of the steel sheet was 400 MPa or less. Similarly also to Test number 16 having the content of Al being greater than 0.50% and Test number 13 having the content of V being greater than 0.10%, the surface hardening depth decreased and the fatigue strength at $10^5$ cycles of the surface of the steel sheet was 400 MPa or less. Further, in Test number 23 containing greater than 0.0015% of B, a prominent decrease in the fatigue strength at $10^5$ cycles of the sheared end surface was able to be suppressed, but B was contained excessively, so that the fatigue strength at $10^5$ cycles of the surface of the steel sheet was 400 MPa or less. It is considered that this is ascribable to delay of diffusion of atomic vacancies caused by B being contained excessively. It was found that the range of the present invention is set to the appropriate component range, and thereby the fatigue strength at $10^5$ cycles of the sheared end surface and the fatigue strength at $10^5$ cycles of the surface of the steel sheet are achieved.

From the above, it was found that the steel sheet of the present invention having the appropriate component range and manufactured by the appropriate manufacturing method is used, thereby making it possible to make the surface hardening depth after the nitriding deep and to exhibit an extremely excellent fatigue property after the nitriding without deteriorating the formability before the nitriding.

What is claimed is:

1. A steel sheet for nitriding, comprising:

in mass %,

C: not less than 0.0002% and not more than 0.07%;

Si: not less than 0.0010% and not more than 0.50%;

Mn: not less than 0.10% and not more than 1.33%;

P: not less than 0.003% and not more than 0.02%;

S: not less than 0.001% and not more than 0.02%;

Cr: greater than 0.80% and 1.20% or less;

Al: not less than 0.10% and not more than 0.50%;

V: not less than 0.05% and not more than 0.10%;

Ti: not less than 0.005% and not more than 0.10%;

B: not less than 0.0001% and not more than 0.0015%; and a balance comprising Fe and inevitable impurities, wherein:

a dislocation density within 50 μm from a surface of the steel sheet in a sheet thickness direction is not less than 2.0 times and not more than 10.0 times a dislocation density at a position which is located at ¼ of a sheet thickness in the sheet thickness direction.

2. The steel sheet for nitriding according to claim 1, further comprising:

one or both of, in mass %,

Mo: not less than 0.001 and not more than 0.20%; and

Nb: not less than 0.001 and not more than 0.050%.

3. A steel sheet for nitriding, comprising:

in mass %,

C: not less than 0.0002% and not more than 0.07%;

Si: not less than 0.0010% and not more than 0.50%;

Mn: not less than 0.10% and not more than 1.33%;

P: not less than 0.003% and not more than 0.02%;

S: not less than 0.001% and not more than 0.02%;

Cr: greater than 0.80% and 1.20% or less;

Al: not less than 0.10% and not more than 0.50%;

V: not less than 0.05% and not more than 0.10%;

Ti: not less than 0.005% and not more than 0.10%;

B: not less than 0.0001% and not more than 0.0015%; and a balance comprising Fe and inevitable impurities, wherein:

a dislocation density within 50 μm from a surface of the steel sheet in a sheet thickness direction is not less than 2.0 times and not more than 10.0 times a dislocation density at a position which is located at ¼ of a sheet thickness in the sheet thickness direction, and the sheet thickness of the steel sheet is 1.6 to 5.0 mm.

* * * * *